United States Patent [19]

Verin

[11] Patent Number: 4,632,483

[45] Date of Patent: Dec. 30, 1986

[54] ELECTRICAL TERMINAL

[75] Inventor: Pierre Verin, Dampmart, France

[73] Assignee: Microdot Inc., Darien, Conn.

[21] Appl. No.: 759,369

[22] Filed: Jul. 26, 1985

Related U.S. Application Data

[63] Continuation of Ser. No. 464,623, Feb. 7, 1983, abandoned, which is a continuation of Ser. No. 229,558, Jan. 29, 1981, abandoned.

[51] Int. Cl.[4] ..... H01R 13/633

[52] U.S. Cl. ..... 339/74 R; 339/258 S

[58] Field of Search ..... 339/74 R, 256 SP, 258 S

[56] References Cited

U.S. PATENT DOCUMENTS

| | | | |
|---|---|---|---|
| 2,759,165 | 8/1956 | Batcheller | 339/256 SP |
| 2,794,963 | 6/1957 | Hess et al. | 339/256 SP |
| 3,796,987 | 3/1974 | Kinkaid et al. | 339/74 R |

FOREIGN PATENT DOCUMENTS

| | | | |
|---|---|---|---|
| 644385 | 7/1962 | Canada | 339/258 S |
| 2464572 | 8/1982 | France . | |
| 858115 | 1/1961 | United Kingdom | 339/258 S |
| 2057790 | 4/1981 | United Kingdom . | |

*Primary Examiner*—John McQuade

*Attorney, Agent, or Firm*—Lyman R. Lyon

[57] ABSTRACT

An electrical connector is disclosed which is of the kind comprising a male tab insertable in a female clip. The female clip (3) has the general form of a hollow parallelepiped the bottom wall (5,6) of which comprises an elastically deformable tab portion (5) (9) engageable in an opening of corresponding male tab portion.

1 Claim, 8 Drawing Figures

FIG. 1
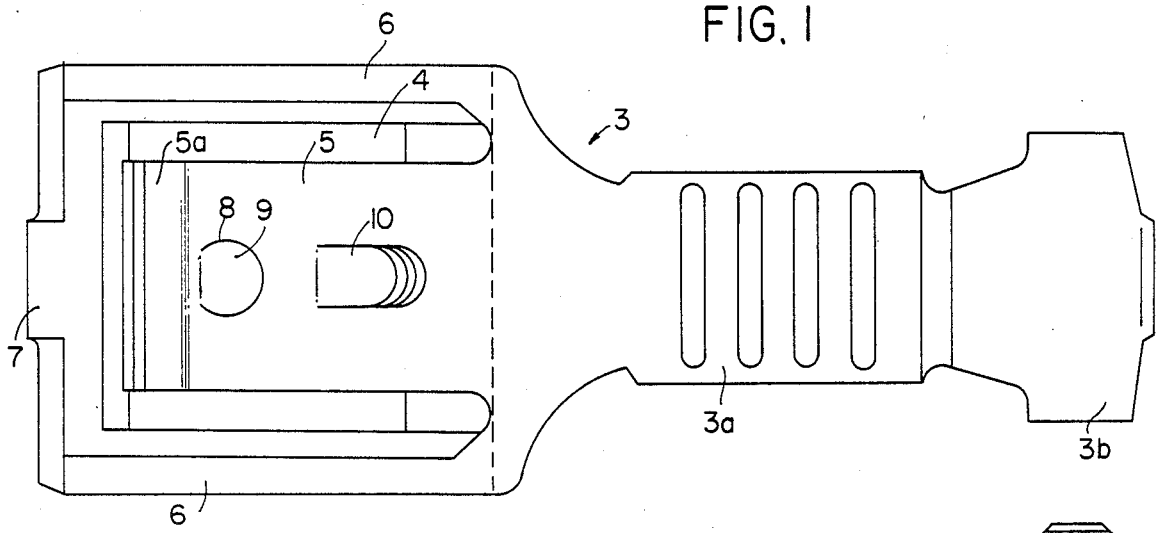
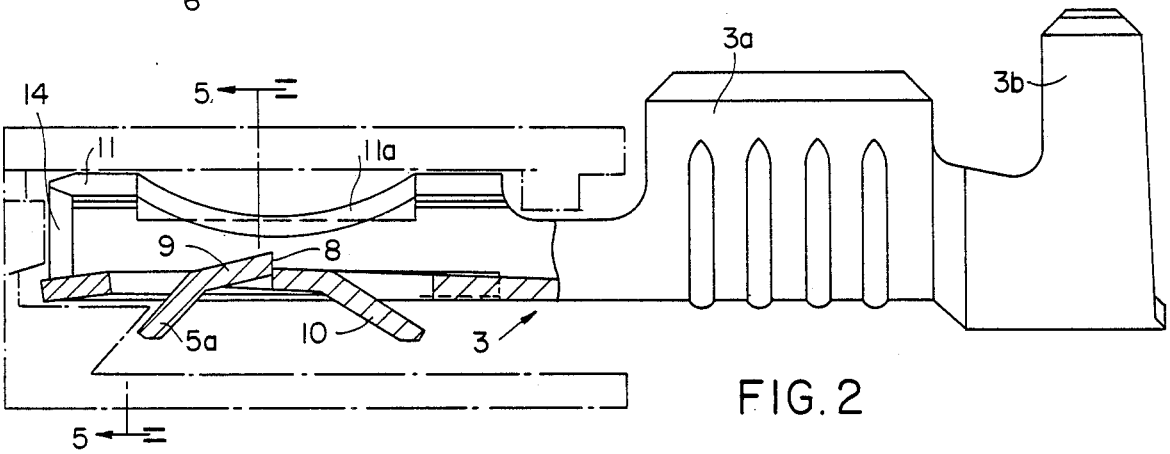
FIG. 2
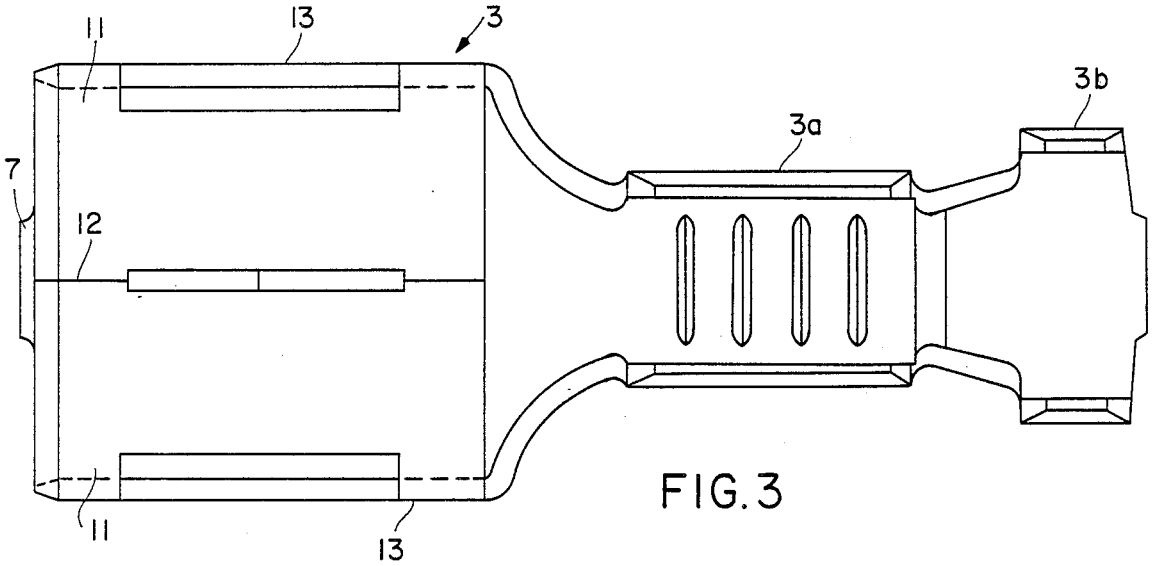
FIG. 3

FIG. 4
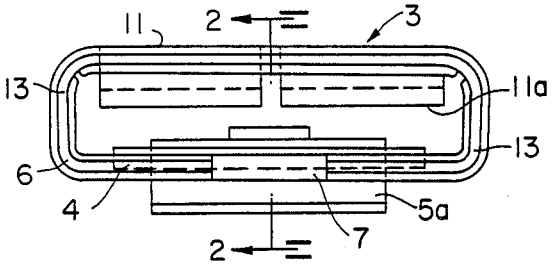
FIG. 5
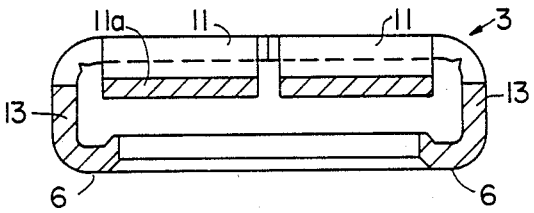
FIG. 6
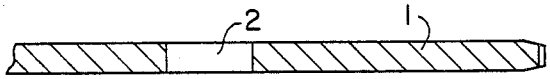
FIG. 7
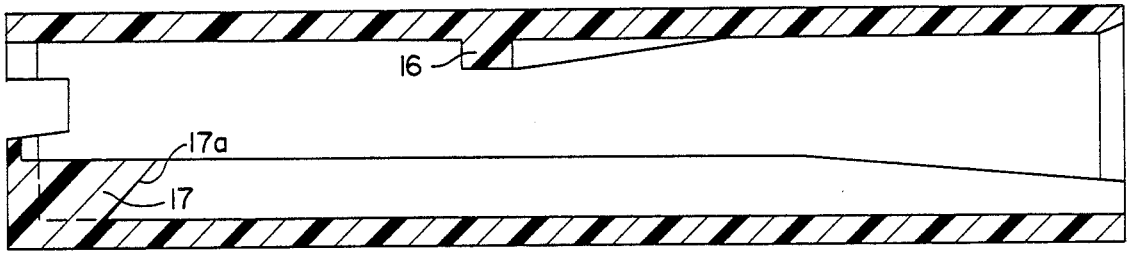
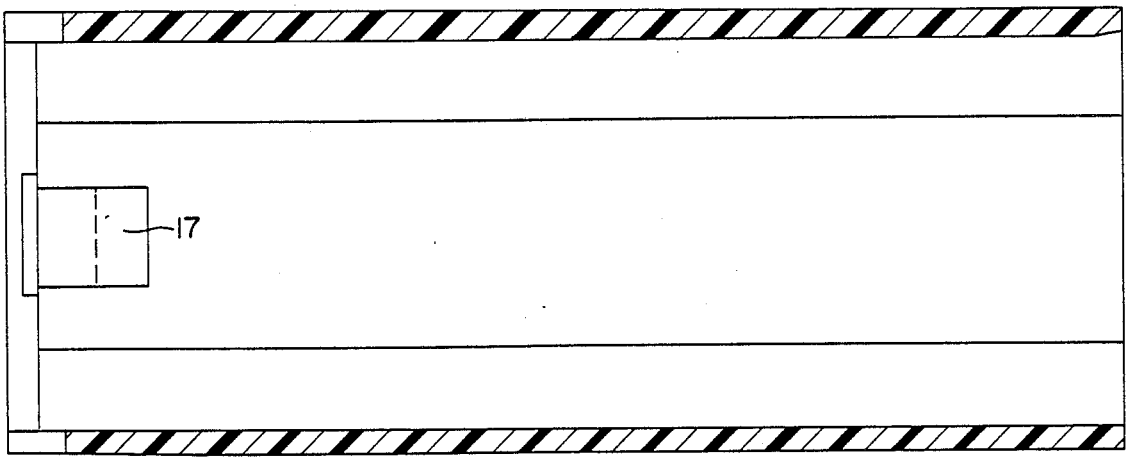
FIG. 8

ELECTRICAL TERMINAL

This is a continuation of co-pending application Ser. No. 464,623 filed on Feb. 7, 1983, now abandoned, which is a continuation of Ser. No. 229,558, filed Jan. 29, 1981, now abandoned.

BACKGROUND OF THE INVENTION

This invention relates to electrical connectors. Electrical connectors have been proposed in which a tab comprising a circular opening is arranged to be force-fitted over a projection provided on the female portion of the connector (referred to herein as "clip") thus providing a locking arrangement. This form of engagement has two disadvantages: on the one hand, the pressure to be exerted on the male and female parts should be sufficiently great to ensure that the female part is deformed until locking takes place, and this sometimes makes assembly difficult; on the other hand, it often happens that the deformation of the female clip is such that it remains to some extent permanent, with the result that accidental disconnection can occur. Moreover, in order to effect disconnection a tool has to be inserted into the clip to deform it again, and this aggravates the deformation of the clip accordingly.

BRIEF SUMMARY OF THE INVENTION

According to the present invention we provide an electrical connector comprising a male tab and a complementary female clip, of the kind in which the female clip has the general form of a hollow parallelepiped one wall member of which comprises an elasically deformable tab provided with a catch engageable in an opening in the male tab, wherein the clip tab is hingedly mounted at its rear end and its front end portion forms an angle of 45° or approximately 45° with the remaining portion of the tab, when in an unstressed condition.

BRIEF DESCRIPTION OF THE DRAWINGS

In order that the invention may be more fully understood, an embodiment in accordance therewith will now be described, with reference to the accompanying drawings, in which:

FIG. 1 is a view from below of a female clip portion of an electrical connector;

FIG. 2 is a side elevation, in partial section, along line 2—2 in FIG. 4, of the clip shown in FIG. 1;

FIG. 3 is a plan view, from above, of the clip shown in FIGS. 1 and 2;

FIG. 4 is an end view of the clip shown in FIGS. 1 to 3;

FIG. 5 is a section on the broken line 5—5 in FIG. 2;

FIG. 6 is a partial longitudinal sectional view of a standardised male tab;

FIG. 7 is a side elevation in longitudinal section through an insulating cap intended to cover the connection and facilitate the disconnection thereof;

FIG. 8 is a plan sectional view of FIG. 7.

DETAILED DESCRIPTION OF THE PREFERRED EMBODIMENTS

Referring initially to FIG. 6, a male portion of the connector comprises a flat rectangular male tab 1 having a central opening 2. The male tab 1 is fixed in known manner to the conducting portion of a conductor (not shown) by a set-in eyelet and to the insulator surrounding this conductor by a clamp fitted on to this insulator.

Such a male tab 1 is known, with standardised dimensions.

FIGS. 2 to 5 inclusive show the female clip 3 portion of the connector which has the general form of a hollow rectangular parallelepiped, for the reception of male tab 1.

Clip 3 comprises an eyelet 3*a* intended to be fitted over a conductor and a clamp 3*b* for fitting on to an insulator.

The lower wall of the parallelepiped portion on the clip 3 has a generally U-shaped cutout portion 4 defining therewithin a central tab 5, as well as two side edges 6 and a front edge 7. A front end portion 5*a* of the central tab 5 is set downwardly at substantially 45° to the remaining portion of the central tab 5 when in an unstressed condition. Behind the portion where the front end portion 5*a* of the central tab 5 meets the remaining portion of the central tab 5 there is provided a substantially circular cutout 8 having a slightly smaller radius than that of the orifice 2 in the male tab 1.

The material of the central tab 5 located inside the cutout 8 is inclined slightly upwards to form a semi-circular catch 9 which projects into the interior of the clip 3.

Preferably, a small tab 10 is cut out inside the central tab 5 and is also inclined downwards in the opposite direction to the tip 5*a* of the tab 5.

Thus, it is apparent that if downward traction is exerted either on the tip 5*a* of the central tab 5, the entire tab 5 is elastically depressed.

The top wall of the parallelepiped portion of the clip 3 comprises two symmetrical portions 11 separated by a cutout 12. Spaced side walls 13 connect the portions 11 to the fixed a bottom wall. Thus, the parallelepiped may be formed from a metal sheet in one piece which is bent back on itself twice so as to comprise: a bottom wall formed by the edges 6 and symmetrical portions 11. The tab 5 and bottom wall connected to the eyelet 3*a* and clamp 3*b*. The symmetrical portions 11 abut on one another along the line 12. The two symmetrical portions 11 forming the top wall of the clip 3 are concavely curved at their central portions 11*a*.

The method of operation of the connecting device thus described is as follows. The male tab 1 is inserted in the clip 3 via the orifice 14 (FIG. 2) of the hollow parallelepiped. The portions 11*a* of the upper wall consisting of two portions 11 press the tab 1 downwards and the tab 1 presses against the catch 9 of the central tab 5, thus causing the latter to be elastically depressed downwards. When the orifice 2 is above the catch 9, the latter penetrates into the orifice 2 and the central tab 5 straightens up again. The male tab 1 is then elastically clamped between the curved walls 11*a* and the bottom wall of the clip 1 consisting of the fixed edges 6 and 7 and the movable tab 5; it is locked in position by the catch 9 which projects into the orifice 2, with the result that accidental disconnection is resisted.

In order to disengage the male tab 1, it is merely necessary to exert downward traction on the central tab 5 either by means of the tip 5*a* or using the small tab 10 so as to free the catch 9 from the orifice 2.

This downward traction may be effected by any suitable means, but is preferably effected by means of a special insulating cap shown in FIGS. 7 and 8.

The cap shown in these figures is a parallelepipedinal sleeve 15 made of a relatively flexible electrically insulating material, such as plastic, which is threaded on to the clip 3 as shown by broken lines in FIG. 2.

The top wall of the sleeve 15 has a projection 16 lockingly engageable with the clip 3 in the vicinity of the eyelet 3*a*. The bottom wall of the sleeve 15 comprises an abutment 17 where inclined wall face 17*a* has a gradient corresponding to or slightly greater than that of the tip 5*a* (50°, for example), this abutment 17 extending over the entire width of the bottom wall of the sleeve 15.

It will be seen that, if the sleeve 15 is slid towards the back of the clip 3, the inclined plane 17*a* engages on the tip 5*a* and forces the tab 5 to move downwards, thus freeing male tab 1 from the catch 9. Thus, the sleeve 15 acts both as an insulating cap for the connection and a control means for disconnection.

Modifications in the details illustrated and described may be made without departing from the spirit and scope of the invention.

I claim:

1. An electrical connector comprising a generally tubular female terminal having an opening of rectangular cross section at one end thereof for the reception of a male terminal and means at the other end thereof for mechanically engaging and electrically connecting an electrical conductor, a male terminal of generally rectangular cross section complementary to the opening in said female terminal so as to be receivable therein, said male terminal having an aperture therein, said female terminal having a lower wall portion with a generally U-shaped cutout comprising spaced generally parallel slots and a connecting slot therein defining a central tab, the connecting slot of said U-shaped cutout being disposed adjacent the one end of said female terminal and orientated generally parallel to a plane containing the opening therein whereby said central tab is cantilevered from the other end of said female terminal, a latching tab on said central tab extending inwardly of the tubular cross section and away from the opening in said female terminal for engagement in the aperture in said male terminal, said central tab having a release tab on a free end portion thereof extending outwardly of the tubular section of said female terminal and in a direction toward the one end thereof, and an insulating sleeve covering said female terminal and having a wedge-shaped abutment thereon, one surface of said abutment defining a cam surface extending generally parallel to said release tab and engageable therewith upon initial movement of said sleeve relative to said female terminal toward the other end thereof, an opposite surface of said abutment being juxtaposed to an outer surface of the lower wall portion of said female terminal, the abutment on said insulating sleeve effecting outward displacement of the latching tab on the central tab on said female terminal and disengagement thereof from said male terminal upon movement of said sleeve toward the other end of said female terminal.

* * * * *